United States Patent [19]

Doi

[11] 4,068,091

[45] Jan. 10, 1978

[54] BINAURAL SOUND PICKUP

[75] Inventor: Toshitada Doi, Yokohama, Japan

[73] Assignee: Sony Corporation, Tokyo, Japan

[21] Appl. No.: 703,791

[22] Filed: July 9, 1976

[30] Foreign Application Priority Data

July 30, 1975 Japan ..... 50-92899

[51] Int. Cl.[2] ..... H04R 5/00

[52] U.S. Cl. ..... 179/1 G; 179/146 R

[58] Field of Search ..... 179/1 G, 1 DM, 1 MF, 179/146 R, 100.1 TD, 100.4 ST

[56] References Cited

U.S. PATENT DOCUMENTS

| | | | |
|---|---|---|---|
| 2,563,010 | 8/1951 | DeBoer et al. | 179/1 G |
| 2,791,628 | 5/1957 | Edmondson | 179/1 G |
| 3,985,960 | 10/1976 | Wallace | 179/1 G |

OTHER PUBLICATIONS

"Stereo Microphone Techniques"; Electronics World; Mar. 1960; pp. 66, 67, 126.

*Primary Examiner*—Douglas W. Olms
*Attorney, Agent, or Firm*—Hill, Gross, Simpson, Van Santen, Steadman, Chiara & Simpson

[57] ABSTRACT

A binaural sound pickup assembly composed of a hollow cone-like member made of plastic resin and having a flange member on its rear portion on the larger diameter portion of the cone-like member and with a pair of microphones mounted by mounting means at both sides of the cone-like member adjacent the flange member and wherein the hollow cone-like member simulates the acoustic characteristics of a human head but which does not give the physical appearance of a human head.

14 Claims, 12 Drawing Figures

BINAURAL SOUND PICKUP

BACKGROUND OF THE INVENTION

1. Field of the Invention

This invention relates in general to sound pickup assembly means and more particularly to a novel sound pickup assembly for use in a binaural sound recording system.

2. Description of the Prior Art

It has been well known to have a binaural recording system for stereophonic recording. Such systems are effective for the use of headphones in the reproduction and the listener feels as if he is present in the concert hall due to the favorable acoustic characteristics.

It has been known in the prior art to have stethoscope type devices in which a pair of microphone units are respectively attached to an arcuate resilient pipe at the opposite ends and a pair of projections are attached to the microphone units for inserting the ends of the pipe into the listener's auditory canals. An output is supplied from the center of the resilient pipe. However, since this device is used for sound pickup by being directly attached to human ears after a long time during which sound pickup occurs the user experiences pain because of the attachment of the device to his head. Also, with such device when the human head is moved very much the picked up sound can be distorted and appear unnatural.

For the above reasons a dummy head imitating a human head is normally used in binaural recording systems. Such prior art dummy heads are quite similar in shape to a human head having a human face and persons sitting in the audience as, for example, in a concert who observe such dummy pickups are unpleasantly affected by such devices. For example if a number of such dummy heads similar to human faces or heads are disposed in a concert hall or the like the entire atmosphere of the hall becomes unpleasant for human listeners present at the concert and, thus, the appreciation of the music is decreased for the persons present at the concert.

It has also been proposed in the prior art to provide a dummy head having dummy external ears attached to a cubical shaped box which is not similar to a human head or face. However, in dummy pickups of this type, the reproduction does not give the sense of direction and distance which is desireable in stereophonic binaural sound pickup devices.

SUMMARY OF THE INVENTION

A binaural sound pickup assembly according to this invention comprising a cone-like member with a projection portion provided at the rear portion of the cone-like member and mounting means for holding right and left microphones which are located in front of the projection portion.

An object of the invention is to provide a novel binaural sound pickup assembly which has the characteristics of a human head but which does not give the appearance to a viewer as a human head.

It is another object of this invention to provide a binaural sound pickup assembly which has the same characteristics as would be obtained if the binaural sound recording was made using a dummy head similar to a human head and face but wherein the pickup device of the present invention does not give the appearance of a human face and head.

It is a further object of this invention to provide a binaural sound pickup assembly such that the microphones can be correctly located opposite to a sound source so as to obtain accurate binaural sound recordings.

It is a further object of the invention to provide a binaural sound pickup assembly which is light in weight and can be easily handled so that binaural sound recordings can be simply performed even by amateurs.

It is still a further object of the invention to provide a binaural sound pickup assembly in which an acoustic damping member is provided at a projection portion of a cone-like member so that unnecessary sound relfections may be effectively eliminated.

It is yet another object of this invention to provide a binaural sound pickup assembly in which the mounting position of microphones can be freely adjusted so as to coincide with the distance between the ears of a user for accurate reproduction.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
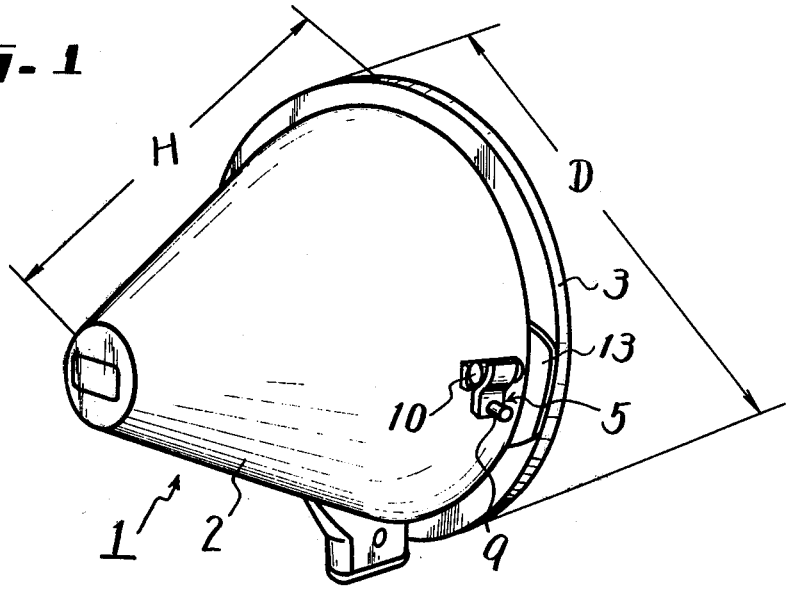
FIG. 1 is a schematic perspective view illustrating an example of a binaural sound pickup assembly according to this invention.
Figure 2:
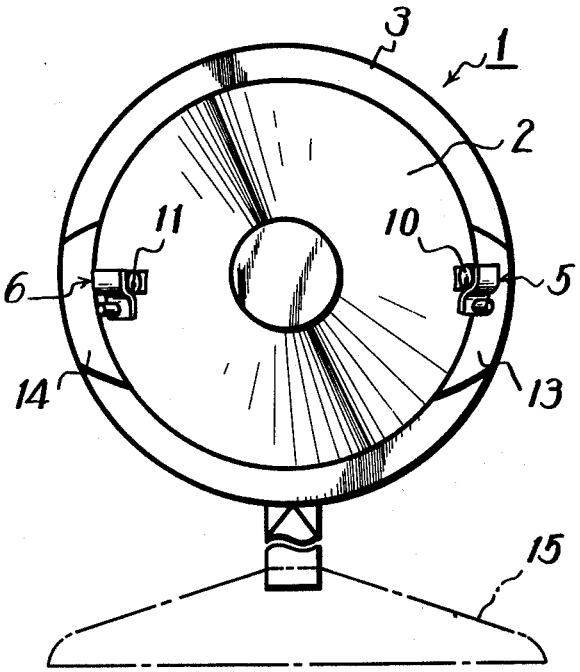
FIG. 2 is a front plan view of the binaural sound pickup assembly shown in FIG. 1.
Figure 3:
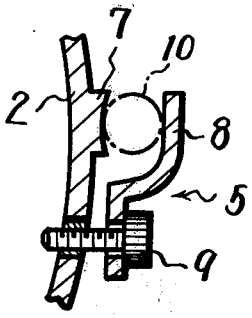
FIG. 3 is a partial sectional view of the device of FIG. 1 which illustrates the mounting means for the microphone.

FIGS. 1, 2 and 3 illustrate a first embodiment of the invention and comprise a binaural sound pickup assembly 1 which serves as a dummy head according to the invention and is comprised of a first truncated cone shaped member 2 having a rear large diameter portion and a forward small diameter portion. A disc shaped back member 3 forms a flange on the rear end surface of the first member 2 at its large diameter. The binaural sound pickup assembly 1 may be formed of, for example plastic resin and the first member 2 will normally be hollow. The second disc shape member 3 is mounted to the first member 2 so as to cover the rear opening of the large diameter portion of the first member 2. As shown in FIG. 2, bilateral microphone mounting means 5 and 6 are provided near the flange-like second member 3 on a horizontal line passing through the center of the rear large diameter portion of the member 2.

FIG. 3 is an enlarged sectional view illustrating the microphone mounting means 5 which is comprised of a receiving portion 7 provided on the cone-like first member 2 and the extending receiving portion 7 has an outer curve surface against which a microphone can be received. A plate member 8 is formed with an opening through which a screw or bolt 9 extends which is threadedly received in an opening formed in the cone-like member 2. Thus, the right and left microphones 10 and 11 can be attached to the conical member 2 by adjusting the screw 9 so as to move the plate 8 to clamp the microphones in place.

Acoustical damping members 13 and 14 which may be made of rubber are attached to the flange-like second member 3 adjacent the microphones 10 and 11. The microphones 10 and 11 are mounted to the mounting means 5 and 6 so that their vibrating plates face the second member 3. The acoustic damping members 13 and 14 may also extend about the entire periphery of the second member 3 and be formed in a ring shape if desired.

As shown in FIG. 2, the binaural sound pickup assembly 1 is supported by a base stand 15 and the height of the pickup assembly 1 may be adjusted by moving it upwardly and downwardly on the supporting post of the stand 15. Under normal operating conditions the small diameter portion of the cone is pointed toward a sound source and the correct sound pickup will occur. Since generally the right and left microphones are adapted to pick up sounds reflected from the flange-like second member 3 or direct sounds from the exterior periphery thereof, the second member 3 acts like human external ears and, hence, the binaural sound pickup operation can be obtained with good characteristics. Also since the second member 3 is provided with acoustic damping members, it will resemble the characteristic of human external ears more accurately. This has been verified by data taken in experiments which will be described later.

Figure 4:
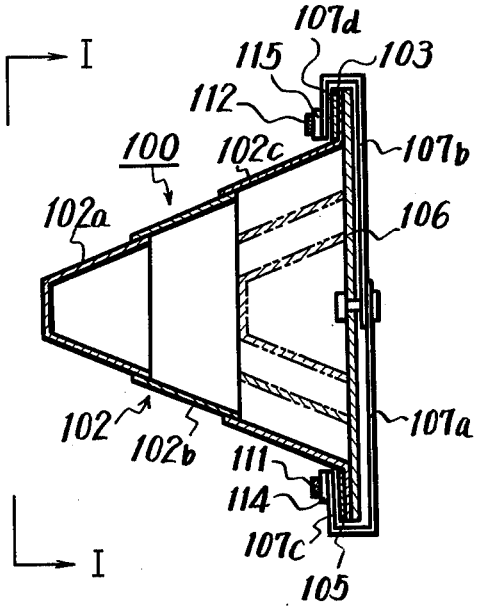
FIG. 4 is a sectional view illustrating a modification of a binaural sound pickup assembly of the invention.
Figure 5:
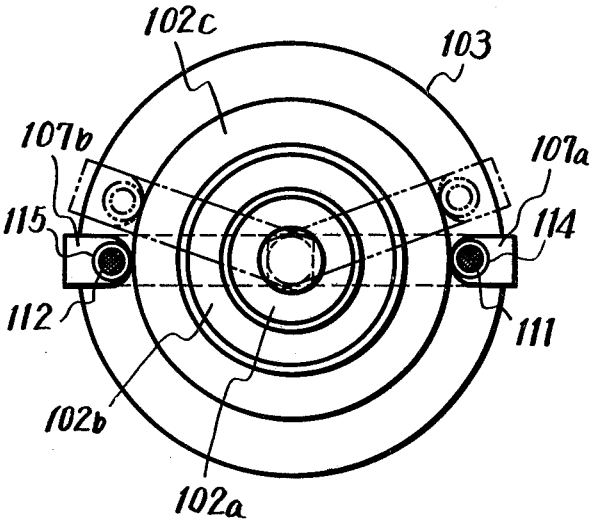
FIG. 5 is a front plan view of the binaural sound pickup assembly illustrated in FIG. 4.

FIGS. 4 and 5 illustrate a modified example of the invention of a binaural sound pickup assembly 100. A cone-shaped first member 102 is composed of a front portion 102*a* which is formed in a tapering manner and has its front end surface closed. The front portion 102*a* mates with a larger truncated conical shape member 102*b* which has a front opening smaller in diameter than the rear opening of the front portion 102*a*. Member 102*b* has a larger rear opening which is received in a third tapered truncated conical rear portion 102*c* which has a front opening smaller than the rear opening of the intermediate portion 102*b* such that the portions 102*a*, 102*b* and 102*c* can be respectively telescoped together to form a relatively flat unit or can be telescoped outwardly to the position shown in FIG. 4 for operation. The rear portion of portion 102*c* is attached to a disc 106 which has a larger diameter than the outer diameter of the rear portion 102*c*. The exterior peripheral face portion extends from the peripheral surface of the rear portion 102*c* and forms a collar-shaped second member 103 upon whose front surface facing the member 102 is attached acoustic damping material 105. A pair of pivoting arm plates 107*a* and 107*b* are pivotally attached to the center of the member 103 and have ends C-shaped members 107*c* and 107*d* which are slidably mounted adjacent the surface 105. Mounting means 114 and 115 are respectively connected to the ends 107*c* and 107*d* for mounting microphones 111 and 112.

The arm plates 107*a* and 107*b* can be pivotally moved to different positions so that the positions of the microphones 111 and 112 relative to the cone-shaped first member 102 can be freely adjusted from the horizontal position in the upper and lower directions as shown in dotted line in FIG. 5. This allows the distance between the microphones 111 and 112 to be adjusted as desired. In the embodiment illustrated in FIGS. 4 and 5 the front portions 102*a* and intermediate portion 102*b* can be telescoped back into the rear portion 102*c* as shown in dotted line in FIG. 4 to substantially reduce the size of the unit when in its stored condition so that the unit can be easily transported.

Figure 6:
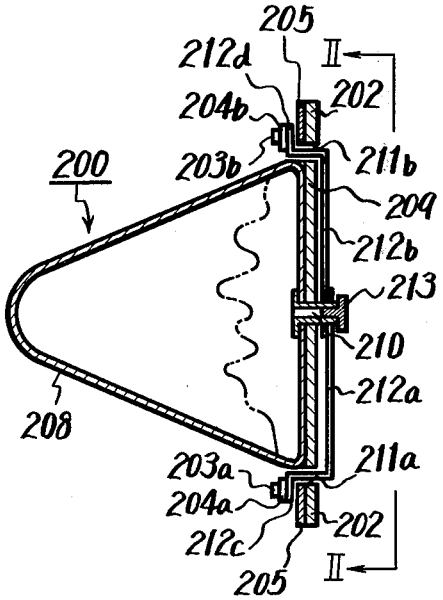
FIG. 6 is a side sectional view illustrating a further modification of the binaural sound pickup assembly of the invention.
Figure 7:
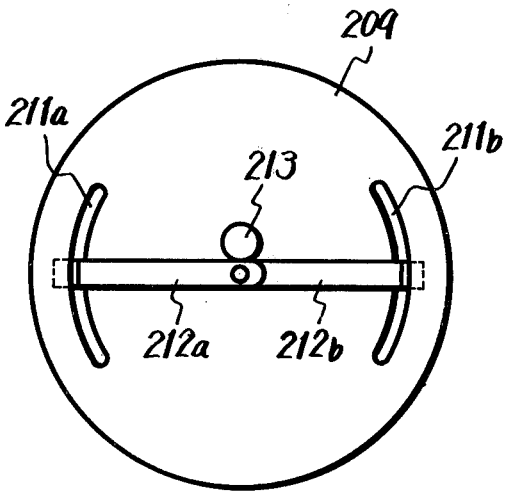
FIG. 7 is a rear view of the binaural sound pickup assembly illustrated in FIG. 6.

FIGS. 6 and 7 illustrate a further modification of the invention comprising an assembly composed of a front balloon-like inflatable hollow member 208 formed as an expansible conical-shaped member. The first member 208 is attached at its rear surface to a disc 209 which has a diameter larger than the outer diameter of the rear portion of member 208 such that its outer peipheral face portion projects beyond the peripheral surface of the first member 208 to form a flange-like second member 202 which as an acoustical dampling member 205 attached to its front surface. The disc 209 is provided at the center of its rear surface with an air inflating and deflating pipe 210 for the first member 208 into which a removable plug 213 is received to allow inflation and deflation of the member 208. Arcuate slots 211*a* and 211*b* are formed in the member 209 and a pair of pivoted arm plates 212*a* and 212*b* are pivotally attached to the center of the disc 209 and have tip portions 212*c* and 212*d* which extend through the slots 211*a* and *b* respectively to the front side of the disc member 203. Mounting means 204*a* and 204*b* for microphones 203*a* and 203*b* are, respectively, formed on the ends of arms 212*a* and 212*b*, respectively. In this example, when the assembly 200 is not used the plug 213 is removed from the pipe 210 to allow the hollow member 208 to be deflated so that it assumes the dotted shape illustrated in FIG. 6 and the unit takes up very little space. When the device is to be used, the plug 213 is removed and air is supplied into the member 208 to inflate it to the solid line position illustrated in FIG. 6 and the plug 213 is inserted into the air tube 210.

In the embodiments described above, if the collar portion of the extending disc on the back of the conical shape front portions are made of an acoustic damping material such as rubber it is not necessary to attach a separate acoustic damping member to the front face thereof.

Acoustical experiments have been conducted with the invention during which the orientation of a sound image when the sound pickup assembly or dummy head is used as well as when an actual human head is used. As illustrated in FIG. 1, dummy heads of six different types were used in the experiments with the lengths H of the first members being either 100, 150 or 200 mm. The diameters D of the collar member were either 240 or 260 mm. In addition, as a human head two kinds were used, one being a male head M and the other a female head W. A drum was used as a sound source and beaten four times each second. Seven directions were selected among twelve directions at every 30° relative to the sound source. Thus, a sound pickup operation occurs from each of the above selected directions by right and left microphones mounted on each dummy head and each human head so as to record the picked up sound on a magnetic tape of a recording apparatus. Further, a recording operation is carried out similarly as described above by means of a dummy head (as shown in FIG. 1) wherein the length H of its cone-shaped first member and the diameter D of its collar-shaped second member are respectively fixed at 100 mm and 240 mm in the cases when the microphones are arranged horizontal and also when they are shifted above and below repectively by 30 °.

The magnetic tape recorded as described above is produced with a suitable machine to produce a sound signal which is furnished to a listener listening with a headphone. In these circumstances, the listener imagines himself to be located at the center of a clock and indicates the positions of the hour and minute hands as he listens to the movement of the reproduced sound signal and these indications by the listener are recorded on a data sheet. After the recorded sound signals have all been reproduced and listened to, the contents of the data sheet are compared with the recording positions so as to obtain data with respect to the following three experimental research items.

A. Rate of correct answers: A rate (%) of correctly decided direction of sound source in which an error within ± 30° is permitted.

B. The appearance rate of unnatural sound images: a rate (%) of appearance of unnecessary sound images such that the location of sound is unclear a sound image enters into a head, a sound is heard from the upper direction and the like.

C. The rate of misjudging at front and rear sides: The rate (%) of making symmetrical misjudgments with respect to a line connecting both ears (such as in a case of 1 and 5 o'clock or 10 and 8 o'clock with the front being assumed as 12 o'clock), wherein an error within ±30° is allowed.

Figures 8A, 8B:
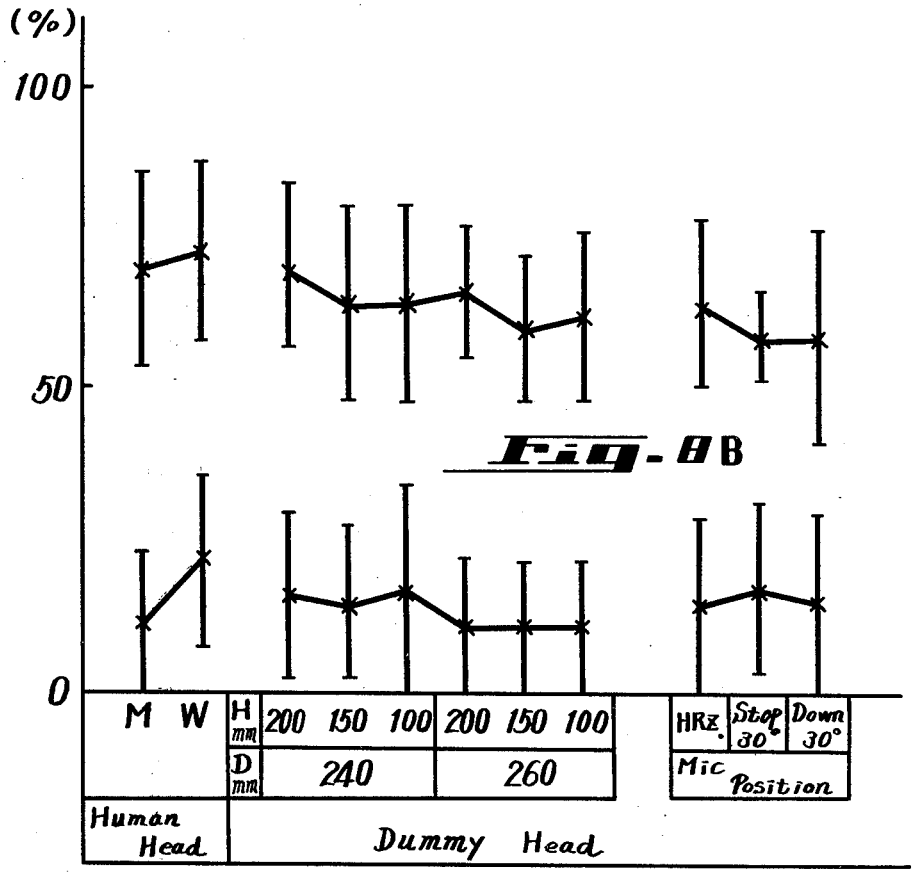
FIGS. 8A, 8B and 8C are graphs illustrating the response of binaural systems.
Figure 8C:
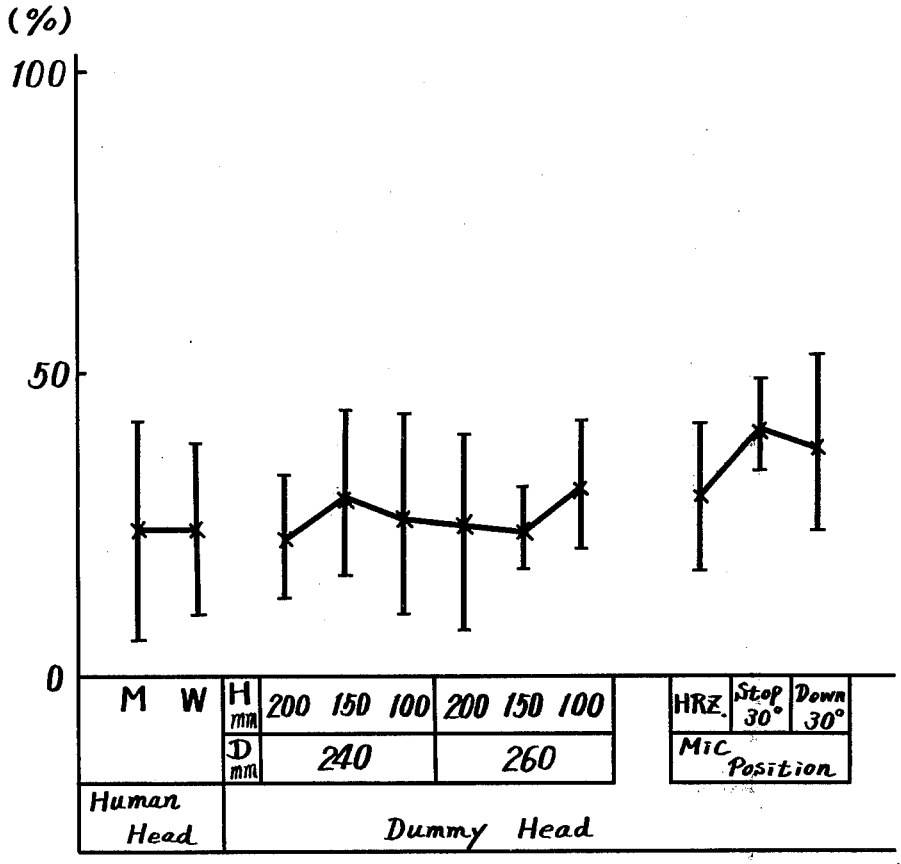

The results shown in graph A, B and C of FIG. 8 were obtained as the average values and standard variations of the respective experimental items described above.

It will be understood that the sound pickup by actual use of a human head has good results as compared with a dummy head, but the dummy head with the length H of its first member being as 200 mm and the diameter D of its second member as 240 mm is almost the same in operation as the human head.

Figure 9A:
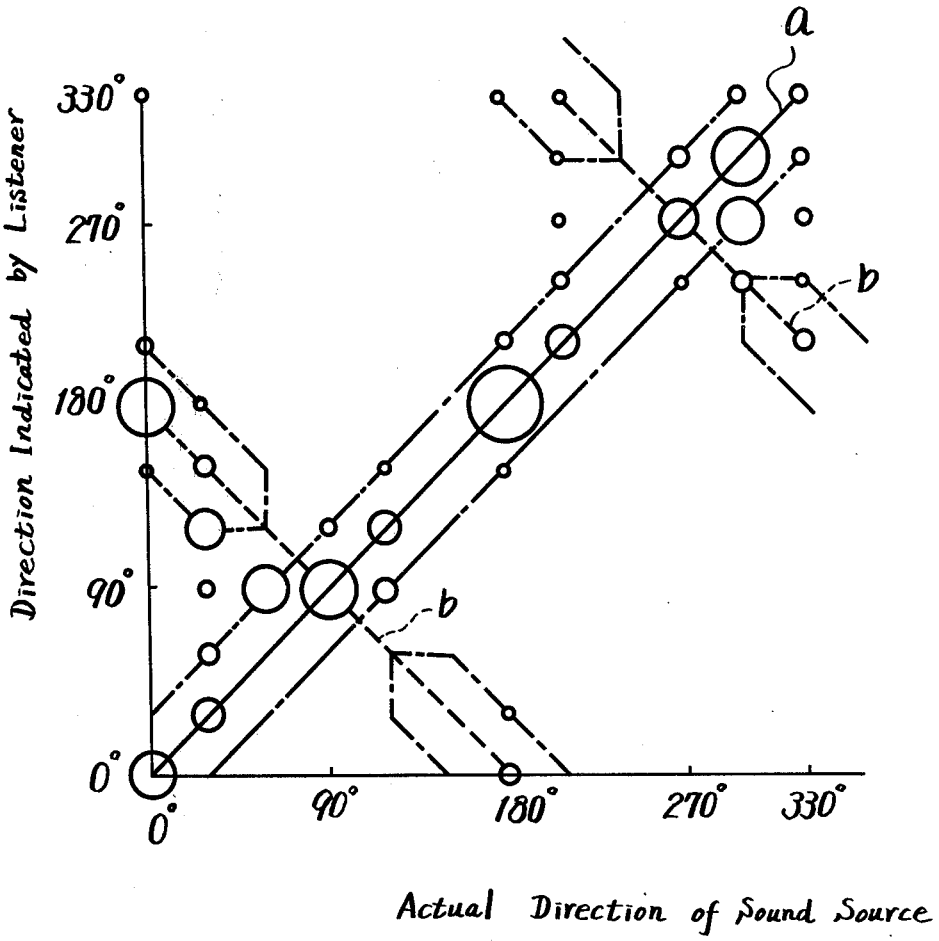
FIGS. 9A and 9B illustrate the response characteristics of human and dummy heads, respectively.
Figure 9B:
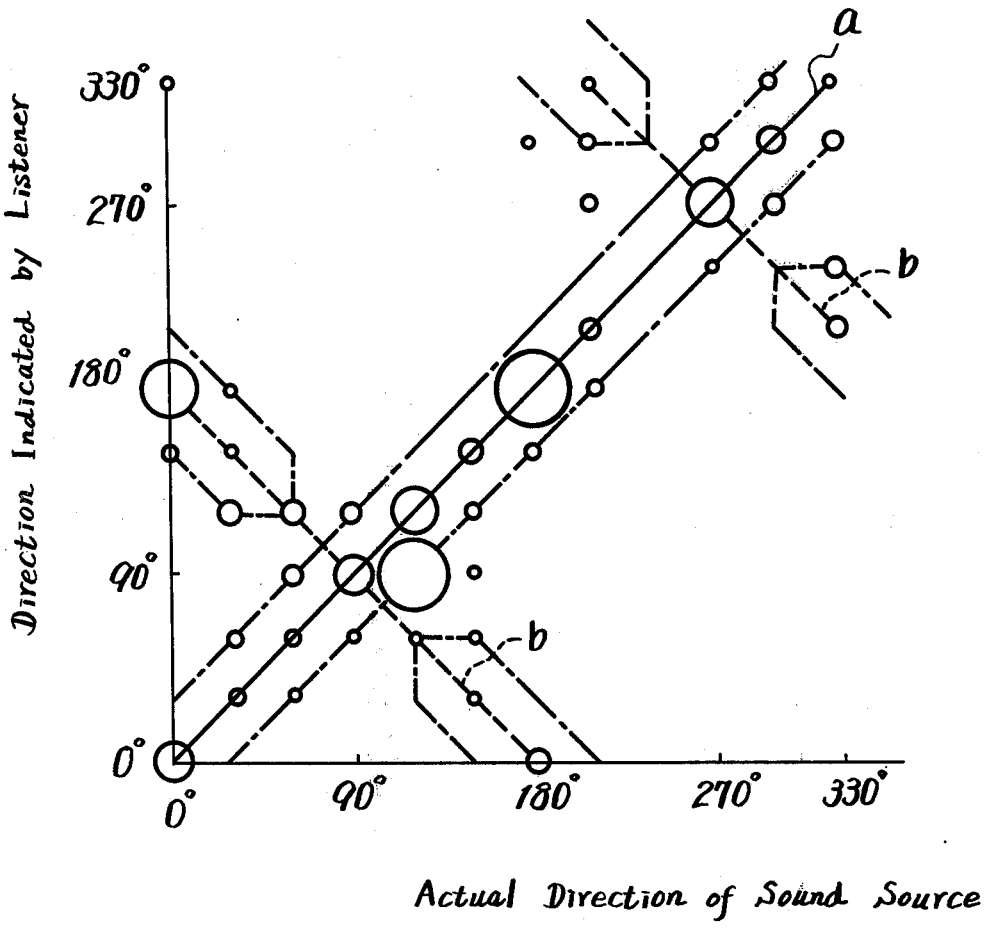

FIG. 9A shows the relationship between directions of sound sources picked up by human heads and listener's indicating directions, and FIG. 9B shows the relationship between directions of sound source picked up by two kinds of dummy heads having the lengths H of the first member and the diameters D of the second member being set as 200 and 240 mm and 150 and 240 mm and listener's indicating directions. That is, FIG. 9A is the case where human heads are used, while FIG. 9B is the case where dummy heads are used. In each figure, abscissa indicates actual direction of a sound source and ordinate indicated direction indicated by a listener with an original point (0°) being set as the front. A 45 -line from the original point (0°) is made as a correct answer reference line *a* and lines intersecting the correct answer reference line *a* at right angles respectively at points of 90° and 270 ° are made as front and rear misjudging reference lines *b*.

In these graphs, if the indication number of a listener is expressed by the size of a circle, the sound pickup indication conditions at the human head and the dummy head exhibit the same tendency. If an indication error of ± 30° is allowed at each of the correct answer reference line *a* and front and rear misjudging reference lines *b*, it will be noticed that most of the data are included in a correct answer area and front and rear misjudging areas. Furthermore, it will be seen that the possibility is high for lateral sound sources to be judged as lateral (90° and 270°) and that there is a possibility which is high for misjudgment of sound from the front 0° or from behind 180 °. However, the possibility is quite small that a sound from the rear 180° will be misinterpreted as being from the front 0°. The above mentioned sound pickup assembly in each embodiment was formed as a truncated cone shaped but the same result is obtained even with a convex shape such as a hemisphere. When the sound pickup assembly is formed to be conical shaped as in the above described embodiments, there is an advantage in that the orientation can be correctly established.

As described above, according to this invention with the simple construction of a dummy head in combination with a conical shaped first member and a collar shaped second member it is possible to obtain the same sound pickup effects as the case where a human head is used for binaural sound pickup and hence the device is very practical. Furthermore since the dummy head is not unnecessarily moved as occurs with a human head the sound pickup can be carried out in a stable state for long periods of time and the binaural sound pickup of natural sounds is possible.

While the principles of the invention have been described in connection with specific embodiments and particular modifications thereof it is to be clearly understood that this description is made only by way of example and not as a limitation on the scope of the invention as defined by the appended claims.

I claim as my invention:

1. A binaural sound pickup assembly comprising:

a first member formed of a conical member having a large-diameter portion and a small-diameter portion, said large- and small-diameter portions being coupled with a continuous surface;

a second member projecting from the large-diameter portion of said first member toward its outer peripheral direction; and microphone mounting means for supporting a pair of microphones which are located at both sides of said first member opposing to said second member.

2. A binaural sound pickup assembly as set forth in claim 1, wherein said second member is provided with acoustic damping members at its portions opposite to said microphones.

3. A binaural sound pickup assembly as set forth in claim 1, wherein said microphone mounting means are each composed of a microphone receiving portion formed on said first member and a means for holding the microphone with said receiving portion.

4. A binaural sound pickup assembly as set forth in claim 3, wherein said holding means consists of a screw and a plate member.

5. A binaural sound pickup assembly as set forth in claim 3, wherein said first member is a hollow member made of plastic resin.

6. A binaural sound pickup comprising:

a conical shaped member for simulating sound reception in characteristic of a human head which has an appearance different from a human head having a larger diameter approximating the diameter of a human head;

a pair of extending acoustical damping members attached to said conical shaped member near its larger diameter portion on opposite sides thereof and extending outwardly in the diameter direction; and a pair of microphones mounted adjacent said pair of extending acoustical damping members.

7. A binaural sound pickup according to claim 6 wherein said pair of microphones are mounted such that they pick-up sound reflected from said pair of extending acoustical damping members and said pair of microphones mounted such that they are moveable about the periphery of said conical shaped member to different angular positions.

8. A binaural sound pickup according to claim 7 wherein said microphones are mounted on a pair of support arms that are moveable relative to said conical shaped member.

9. A binaural sound pickup according to claim 6 wherein said pair of microphones are attached to said conical shaped member by a pair of clamps.

10. A binaural sound pickup according to claim 6 including a back plate attached to the larger diameter end of said conical shaped member and extending beyond said conical shaped member.

11. A binaural sound pickup according to claim 10 wherein sound damping material is attached to the extending portion of said back plate and said pair of extending acoustical damping members formed thereby.

12. A binaural sound pickup according to claim 11 wherein said conical shaped member is formed of a plurality of telescoping portions which in the extended position form a cone and which can be nested into a stored position.

13. A binaural sound pickup according to claim 10 wherein said conical shaped member is formed of flexible gas impervious material and means for inflating and deflating said conical shaped member.

14. A binaural sound pickup according to claim 13 including a pair of arms pivotally supported by said back plate, a pair of arcuate slots formed in said back plate and portions of said arms extending therethrough and said pair of microphones supported on the portions of said arms which extend through said slots.

* * * * *